US007156504B2

(12) United States Patent
Akahane

(10) Patent No.: US 7,156,504 B2
(45) Date of Patent: Jan. 2, 2007

(54) LIQUID EJECTION HEAD

(75) Inventor: Fujio Akahane, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 10/612,875

(22) Filed: Jul. 7, 2003

(65) Prior Publication Data

US 2005/0116992 A1 Jun. 2, 2005

(30) Foreign Application Priority Data

Jul. 5, 2002 (JP) ..... P2002-196912
Jul. 5, 2002 (JP) ..... P2002-196913
Jun. 27, 2003 (JP) ..... P2003-183949

(51) Int. Cl.
*B41J 2/045* (2006.01)

(52) U.S. Cl. ..... 347/70; 347/72

(58) Field of Classification Search ..... 347/68–73, 347/54; 29/25.35, 890.1
See application file for complete search history.

(56) References Cited

U.S. PATENT DOCUMENTS 5,818,482 A * 10/1998 Ohta et al. ..... 347/70
6,139,132 A * 10/2000 Yasukawa et al. ..... 347/70
2002/0005879 A1* 1/2002 Kitahara ..... 347/68

FOREIGN PATENT DOCUMENTS

JP 9-99557 A 4/1997
JP 2001-113697 * 4/2001
JP 2001-113697 A 4/2001
JP 2002-361868 A 12/2002

* cited by examiner

*Primary Examiner*—Stephen Meier
*Assistant Examiner*—Geoffrey S. Mruk
(74) *Attorney, Agent, or Firm*—Sughrue Mion, PLLC

(57) ABSTRACT

A metallic cavity unit is formed with liquid flow passages respectively continued from a common liquid reservoir to nozzle orifices via pressure chambers. In an actuator unit, a plurality of piezoelectric elements are supported on a fixation plate in a cantilevered manner. A resin casing is formed with a first face onto which the cavity unit is bonded, and an actuator chamber which accommodates the actuator unit therein such that free ends of the piezoelectric elements are abutted onto the cavity unit. A metallic reinforcement member is integrally molded with the casing such that at least a part thereof is buried in the casing at the vicinity of the first face.

7 Claims, 10 Drawing Sheets

LIQUID EJECTION HEAD

BACKGROUND OF THE INVENTION

The present invention relates to liquid ejection heads used in liquid jetting devices such as ink jet recording heads used in image recording apparatuses such as a printer, colorant ejection heads used for manufacture of color filters of a liquid crystal display etc., electrode material ejection heads used for formation of electrodes of an organic EL (electroluminescence) display, an FED (field emission display), etc., and bio-organic material ejection heads used for manufacture of bio-chips (biochemical devices).

A liquid ejection head is known that is equipped with: an actuator unit in which a piezoelectric element group is joined to the surface of a metal fixing plate; a case that houses the actuator unit; and a cavity unit in which pressure generating chambers and nozzle orifices are formed and that is joined to the front end of the case.

The above case is made of a synthetic resin such as an epoxy resin to facilitate shaping process and mass-production. An chamber for accommodation and fixing of the actuator unit is formed in the case. The chamber is provided for each actuator unit if there exist a plurality of actuator units. Therefore, in a liquid ejection head having a plurality of actuator units, a partition that was molded integrally with the case is provided between adjoining chambers. Each actuator unit is fixed in the associated chamber by bonding it to a partition wall of the case in a state that the piezoelectric element group is divided into piezoelectric elements with the same pitch as the arrangement pitch of the nozzle orifices are positioned with respect to respective pressure generating chambers, more specifically, a vibration plate that seals the pressure generating chambers.

The cavity unit is formed by bonding together a nozzle plate through which a plurality of nozzle orifices are formed, a chamber formation plate that forms pressure generating chambers corresponding to the respective nozzle orifices, and a vibration plate that seals the chamber formation plate and to which the free end portions of the piezoelectric elements are joined. The nozzle plate and the chamber formation plate of the cavity unit are made of silicone or a metal such as stainless steel because they should be highly rigid to keep the liquid droplet jetting characteristic constant. On the other hand, the vibration plate is a composite member having a double-layer structure in which a resin elastic film or metal foil is laminated on a metal support plate.

Temperature variation causes a large difference between expansion or contraction lengths of the case and the cavity unit because of a large difference between the linear expansion coefficients of a synthetic resin as the material of the case and a metal as the material of the cavity unit. As a result, peeling may occur between the case and the cavity unit, in particular, at end portions of the bonding area and both ends of each pressure generating chamber, even when a case as small as about 2 μm, for example, expands or contracts.

When the liquid ejection head is placed in a high-humidity environment or, conversely, in a dry environment, the above-mentioned case made of a synthetic resin is deformed through moisture absorption or release. Such deformation may cause peeling of the case and the cavity unit off each other. In case where the case is deformed, there is an anxiety that the actuator unit fixed to the case, that is, the piezoelectric elements are inclined. In such a case, stress acts on the bonding boundaries between the piezoelectric elements and the vibration plate and the piezoelectric elements become prone to peel off the vibration plate. If the piezoelectric elements are driven in this state, the ejection of liquid droplets may receive adverse effects such as generation of crosstalk.

In view of the above, an attempt to employ a metal case has been made. However, this is associated with a problem that it is more difficult to work a metal case into a complex shape than a resin case and hence the production efficiency cannot be increased easily.

For example, Japanese Patent Publication No. 9-99557. (cf., page 4 and FIG. 1) discloses a configuration in which a buffer member made of metal or thermosetting resin is interposed between the case (frame) and the cavity unit (ink chamber formation member) to reduce the stress generated between the case and the cavity unit resulting from the difference between the linear expansion coefficients thereof.

However, the deformation (expansion or shrinkage) of the case cannot be avoided securely by merely providing the buffer member between the case and the cavity unit. Accordingly, the disadvantageous situation resulting from the case deformation cannot be suppressed securely.

SUMMARY OF THE INVENTION

The present invention has been made in view of the above circumstances, and the main object of the invention is to provide a liquid ejection head capable of securing the reliability of bonding by preventing problems from occurring due to temperature variation or humidity variation.

It is another object of the invention to provide a liquid ejection head capable of stabilizing the ejection of liquid droplets.

It is still another object of the invention to provide a liquid ejection head in which an actuator unit can be precisely is placed at a predetermined position.

In order to achieve the above object, according to the invention, there is provided a liquid ejection head, comprising:

a metallic cavity unit, formed with liquid flow passages respectively continued from a common liquid reservoir to nozzle orifices via pressure chambers;

an actuator unit, in which a plurality of piezoelectric elements are supported on a fixation plate in a cantilevered manner;

a resin casing, formed with a first face onto which the cavity unit is bonded, and an actuator chamber which accommodates the actuator unit therein such that free ends of the piezoelectric elements are abutted onto the cavity unit; and a metallic reinforcement member, integrally molded with the casing such that at least a part thereof is buried in the casing at the vicinity of the first face.

In such a configuration, since the metallic reinforcement member is disposed between the casing and the cavity unit in a state that at least a part thereof is buried in the casing, it is possible to suppress the deformation of the casing, particularly the deformation at the vicinity of the first face. In other words, the linear expansion coefficient at the vicinity of the face to which the cavity unit is joined can be matched with the linear expansion coefficient of the cavity unit. Accordingly, not only the reliability of bonding between the casing and the cavity unit can be secured, but also the offset or peeling occurred between the casing and the reinforcement member can be avoided.

Here, "at the vicinity of the first face" represents a range capable of attaining the reinforcement for the bonding between the cavity unit and the casing under a condition that at least a part of the reinforcement member is buried in the casing. Specifically, the range is preferably 1 mm inwardly from the first face.

Preferably, the reinforcement member extends in the casing so as to surround the actuator chamber.

Preferably, a whole body of the reinforcement member is buried in the casing. Here, "a whole body" represents a state that the reinforcement member is almost buried in the casing. That is, the reinforcement member may be slightly exposed from the casing. There may be configured such that a part of the reinforcement member serves as the first face.

Preferably, the reinforcement member is formed with a hole filled with resin forming the casing. In such a configuration, the reinforcement member can be coupled with the casing more securely.

Preferably, the reinforcement member is formed with an anchor member projecting into the casing. In such a configuration, the difficulty to detach the reinforcement member from the casing can be provided.

Preferably, the reinforcement member is comprised of a metal selected from the group consisted of stainless steel, nickel, aluminum, alumetized aluminum and nickel-plated aluminum.

According to the invention, there is also provided a liquid ejection head, comprising:

a metallic cavity unit, formed with liquid flow passages respectively continued from a common liquid reservoir to nozzle orifices via pressure chambers;

an actuator unit, in which a plurality of piezoelectric elements are supported on a metallic fixation plate in a cantilevered manner and arranged in a first direction;

a resin casing, formed with an actuator chamber which accommodates the actuator unit therein such that free ends of the piezoelectric elements are abutted onto the cavity unit; and a metallic reinforcement member, disposed between the casing and the cavity unit so as to provide a through hole communicated with the actuator chamber, wherein:

the through hole comprises a first part having a first dimension in a second direction perpendicular to the first direction which is substantially equal to a thickness of the fixation plate, and a second part having a second dimension in the first direction which is substantially equal to a dimension between outermost end faces of the piezoelectric elements in the first direction; and the actuator unit is bonded to the reinforcement member, while the fixation plate is accommodated in the first part of the through hole and the piezoelectric elements are accommodated in the second part of the through hole.

In such a configuration, since the reinforcement member, the fixation plate and the cavity unit are made of metal, the linear expansion coefficients of these members can be matched with each other. Accordingly, the relative expansion or shrinkage difference among these member resulting from the temperature or humidity variation can be suppressed, thereby preventing the offset or peeling from occurring among these members.

Further, since the fixation plate for the actuator unit is joined to the metallic reinforcement member, not only the affection of the casing deformation (i.e., generation of crosstalk resulting from the inclination of the actuator unit) can be prevented, but also the reaction force generated when the piezoelectric elements are actuated can be sufficiently received by the reinforcement member to normalize the driving of the piezoelectric elements. Therefore, the ejection of liquid droplets can be stabilized.

Further, since the dimension of the through hole in the reinforcement member through which the actuator unit extends is so determined as to restrict the position of the actuator unit, it is possible to place the actuator unit at a predetermined position easily and precisely, thereby enhancing the productivity.

Preferably, the reinforcement member is formed by laminating a first plate member formed with the first part of the through hole and a second plate member formed with the second part of the through hole.

Preferably, the reinforcement member is a one-piece member obtained by forging and punching.

Preferably, a thickness of the reinforcement member is substantially equal to a longitudinal dimension of the piezoelectric elements.

Preferably, a thickness of the reinforcement member is substantially equal to a longitudinal dimension of the piezoelectric elements. In such a configuration, it is possible to obtain a region enough to support (bond) the actuator unit. Accordingly, the reaction force generated from the actuated piezoelectric elements can be sufficiently received by the reinforcement member, thereby stabilizing the ejection property of liquid droplets.

Preferably, the reinforcement member is formed with a hole filled with resin forming the casing. In such a configuration, the reinforcement member can be coupled with the casing more securely.

Preferably, the reinforcement member is formed with an anchor member projecting into the casing. In such a configuration, the difficulty to detach the reinforcement member from the casing can be provided.

Preferably, the reinforcement member is comprised of a metal selected from the group consisted of stainless steel, nickel, aluminum, alumetized aluminum and nickel-plated aluminum.

DETAILED DESCRIPTION OF THE INVENTION

Figure 1:
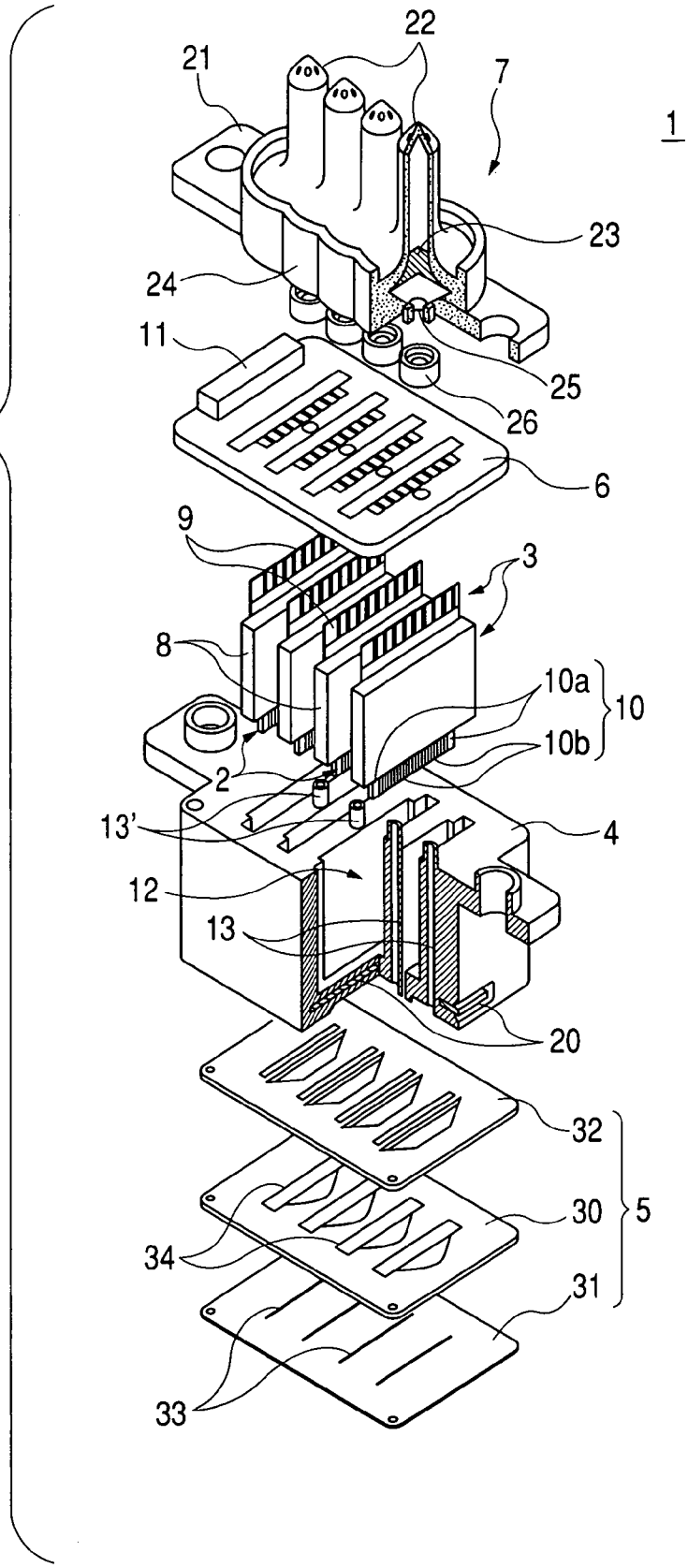
FIG. 1 is a perspective view of a disassembled recording head according to a first embodiment of the invention.

Preferred embodiments of the invention will be described below with reference to the accompanying drawings.

A recording head 1 according to a first embodiment of the invention is generally composed of: actuator units 3 having respective piezoelectric element groups 2; a case 4 that houses and supports the actuator units 3; a cavity unit 5 that is joined to one surface of the case 4; a connection board 6 that is placed on the other surface, that is, the surface opposite to the cavity unit 5, of the case 4, and a supply needle unit 7 that is attached to the case 4 via the connection board 6.

Each of the actuator units 3 is composed of the piezoelectric element. group 2, a fixation plate 8 to which the piezoelectric element group 2 is joined, and a flexible cable 9 for supplying drive signals to the piezoelectric element group 2.

The piezoelectric group 2 consists of a plurality of arrayed piezoelectric elements 10. The piezoelectric elements 10 include a pair of dummy elements 10*a* that are located on both ends of the array of drive elements 10*b*. For example, pectinated 180 drive elements 10*b* has a very narrow width of about 50 to 100 μm. The dummy elements 10*a*, which are sufficiently wider than the drive elements 10*b*, serve to protect the drive elements 10*b* from impact etc. and to guide the actuator unit 3 to a prescribed position.

The fixed end portion of each piezoelectric element 10 is joined to the fixation plate 8, whereby its free end portion projects outward from the front face of the fixation plate 8. That is, each piezoelectric element 10 is supported by the fixation plate 8 in a cantilevered manner. The free end portion of each piezoelectric element 10 is formed by laminating piezoelectric members and internal electrodes alternately, and expands or contracts in the element longitudinal direction when a voltage difference is given to confronting electrodes.

The flexible cable 9 is electrically connected to the piezoelectric elements 10 at a surface opposite to the fixation plate 8. The surface of the flexible cable 9 is mounted with a control IC (not shown) for controlling driving etc. of the piezoelectric elements 10. The fixation plate 8 which supports the piezoelectric elements 10 is a metallic plate member that is rigid enough to sustain reaction force from the piezoelectric elements 10. In this embodiment, the fixation plate 8 is made of stainless steel.

The connection board 6 is a wiring board on which electrical wiring for various signals to be supplied to the recording head 1 is formed and to which a connector 11 to which a signal cable can be connected is attached. The electrical wiring of each flexible cable 9 is connected to the connection board 6 by soldering or the like. The leading end of a signal cable from a controller (not shown) is inserted into the connector 11.

The case 4 is a block-like member formed by molding, for example, a synthetic resin such as an epoxy resin that can easily be shaped in a desired manner. Chambers 12 that accommodate the respective actuator units 3 and ink supply passages 13 (liquid supply passages) that are parts of ink flow passages are formed through the case 4 (ink is kind of liquid).

The surface of the case 4 to be joined with the cavity unit 5 is formed with recesses 14 that serve as common ink chambers (common liquid chamber). In this embodiment, a metallic reinforcement member 20 is integrally molded (by insertion molding) with the case 4 such that the reinforcement member 20 is disposed in the vicinity of the surface joined with the cavity unit 5. Detailed explanations for the reinforcement member 20 will be provided later with reference to FIGS. 4A and 4B.

Each ink supply passage 13 penetrates through the case 4 in the height direction, and its one end communicates with the associated recess 14 that serve as a common ink chamber 44. The top end portion of each ink supply passage 13 is formed inside an associated connection port 13' that projects from the top surface of the case 4. The height direction is the stacking direction of the members in which a nozzle plate is referred as the lowest member.

The supply needle unit 7 is a member to which ink cartridges (not shown) are connected, and is generally composed of a needle holder 21, ink supply needles 22, and filters 23.

The ink supply needles 22 are portions that are inserted into the respective ink cartridges, and serve to introduce inks that are stored in the respective ink cartridges into the recording head 1. The tip portion of each ink supply needle 22 is pointed so as to assume a cone shape and hence can easily be inserted into an ink cartridge. A plurality of ink introduction holes penetrate through the tip portion of each ink supply needle 22 so that the inside and the outside of the ink supply needle 22 communicate with each other. Capable of ejecting four kinds of inks, the recording head 1 according to this embodiment is equipped with four ink supply needles 22.

The needle holder 21 is a member to which the ink supply needles 22 are attached. The surface of the needle holder 21 is formed with a pedestal 24 to which the base portions of the ink supply needles 22 are attached. Ink supply holes 25 penetrate through the bottom surface of the pedestal 24 in the thickness direction of the needle holder 21. The needle holder 21 has flanges that project sideways.

The filters 23 are members for preventing passage of foreign manner in inks such as dust and burrs that were produced at the time of molding, and are metal fine-mesh nets, for example. The filters 23 are bonded to filter holding grooves that are formed in the pedestal 24.

The supply needle unit 7 is placed on the top surface of the case 4. In a state that the supply needle unit 7 is thus placed, the ink ejection holes 25 of the supply needle unit 7 and the ink supply passages 13 of the case 4 communicate with each other via packings 26, respectively, in a liquid-tight manner.

Next, the cavity unit 5 will be described. The cavity unit 5 is configured in such a manner that a nozzle plate 31, a chamber formation plate 30, and a vibration plate 32 are stacked in this order and bonded to each other to form an integral member.

Although in this embodiment the cavity unit 5 is made of a metal, a resin film may be used as part of the cavity unit 5. The point is that the linear expansion coefficient of the entire cavity unit 5 should be equivalent to that of a metal.

The nozzle plate 31 is a stainless steel plate through which nozzle orifices 33 are formed in arrays with a pitch corresponding to a dot formation density. In this embodiment, for example, each nozzle array is formed by 180 nozzle orifices 33 that are arranged with a pitch 180 dpi and four nozzle arrays corresponding to four kinds of inks are arranged side by side in the primary scanning direction of the recording head 1.

Figure 2:
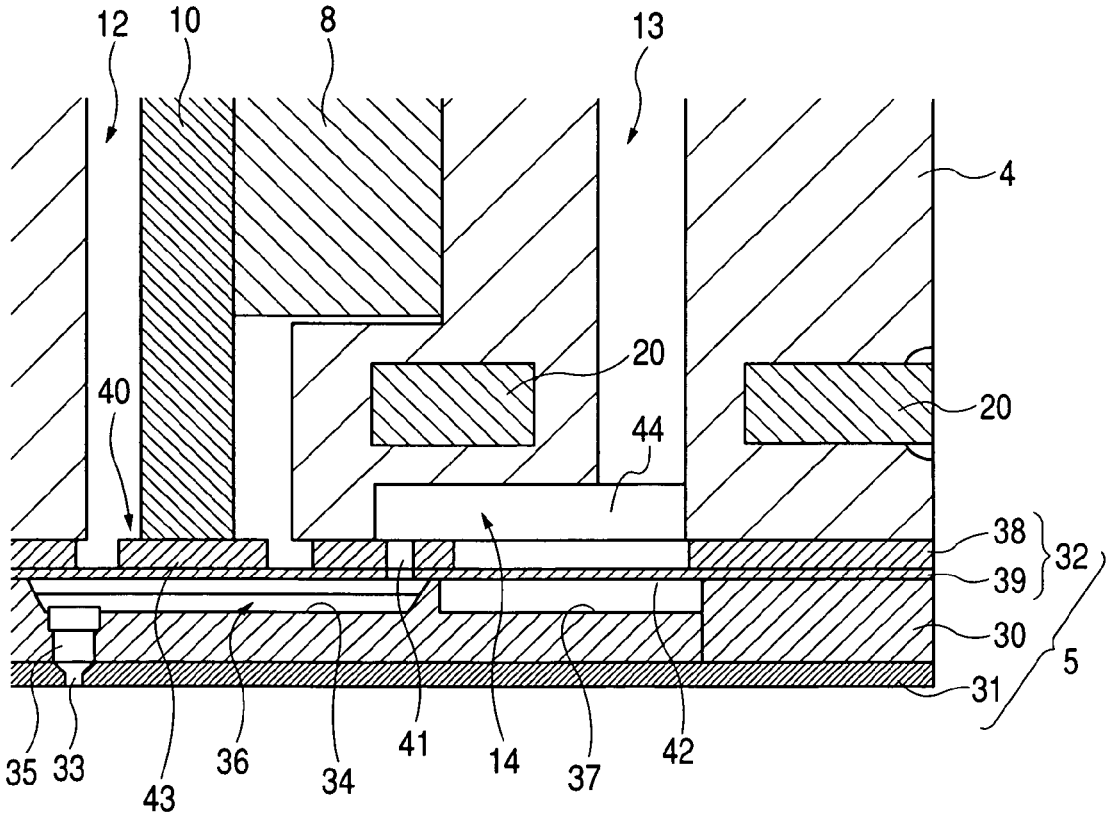
FIG. 2 is a sectional view of an essential part of the recording head.

As shown in FIGS. 1 and 2, the chamber formation plate 30 is a plate member in which recesses 34 corresponding to the respective nozzle orifices 33 of the nozzle plate 31 are arranged in the direction that the nozzle orifice are arrayed (the secondary scanning direction of the recording head 1) and communication ports 35 that communicate with the nozzle orifices 33 are formed at one ends of the recesses 34, respectively. With its opening sealed by the vibration plate 32, each recess 34 defines a pressure generating chamber 36. Escape recesses 37 allowing compliance portions 42 of the common ink chambers 44 to operate are formed in the chamber formation plate 30. A substrate made of silicone or a metal such as stainless steel or nickel is used preferably to form the chamber formation plate 30. In this embodiment, the chamber formation plate 30 is formed by pressing a stainless steel substrate.

Figure 3A:
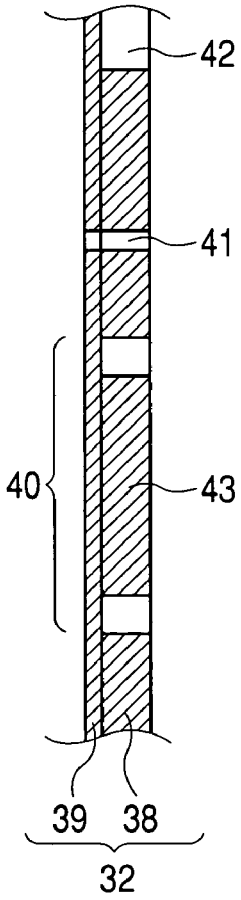
FIG. 3A is a sectional view of an essential part of a vibration plate of the recording head.

As shown in FIG. 3A, the vibration plate 32 is a two-layered plate member consisting of a support plate 38 and an elastic film 39. In this embodiment, the support plate 38 is a stainless steel plate and the elastic film 39 is a stainless steel film (a kind of metal foil). It is possible to use, as the elastic film 39, films other than the stainless steel film such as a resin film of PPS (polyphenylene sulfide) or the like. Where a resin film is used, the vibration plate 32 has a two-layered structure of the metal plate and the resin film.

Figure 3B:
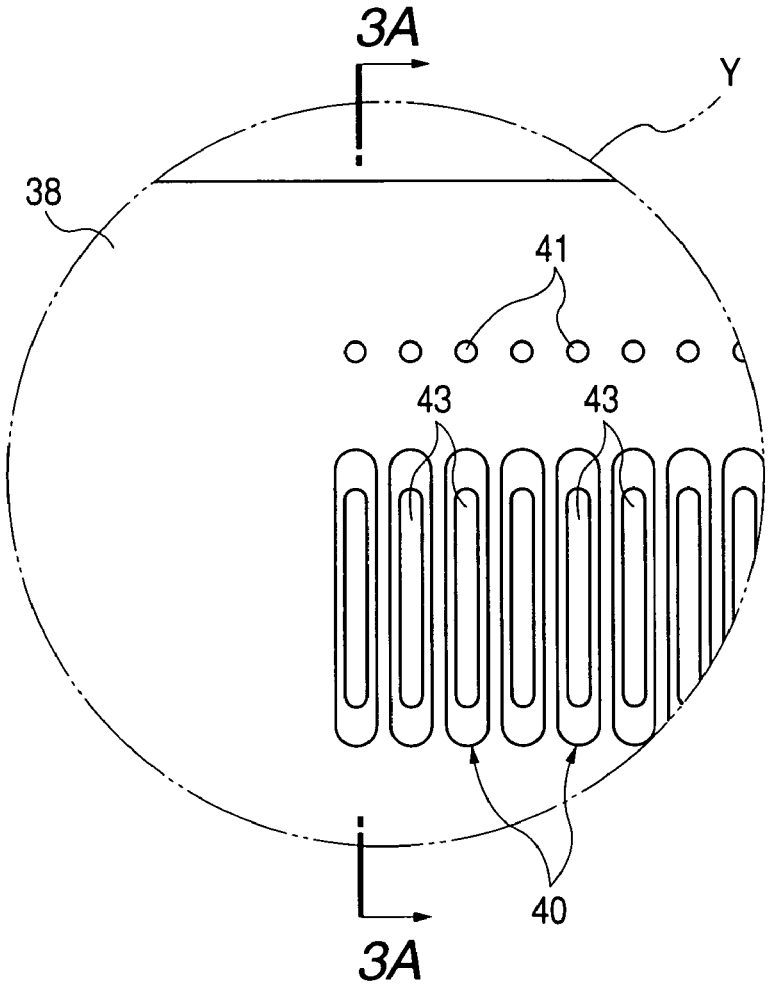
FIG. 3B is an enlarged plan view of a part of the vibration plate.

Diaphragm portions 40, ink supply holes 41, and compliance portions 42 are formed in the vibration plate 32. As shown in FIG. 3B, the diaphragm portions 40 are arranged in direction that the piezoelectric elements are arrayed, so as to correspond to the respective recesses 34 and to seal of the openings of the recesses 34 of the chamber formation plate 30. Each diaphragm portion 40 is formed in such a manner that in an area corresponding to the associated recess 34 is annularly thinned so as to leave only the elastic film 39. An island portion 43 is formed inside the annularly thinned portion. The island portion 43 is a portion to which the tip face of the associated piezoelectric element 10 is joined.

The ink supply holes 41 are holes to allow the respective pressure generating chambers 36 to communicate with the common ink chamber 44, and penetrate through the vibration plate 32 in the thickness direction. Like the diaphragm portions 40, the ink supply holes 41 are provided for the respective recesses 34 and arrayed.

Each compliance portion 42 is a portion that defines part of the associated common ink chamber 44. That is, each compliance portion 34 seals the opening of the recess 14 of the case 4 and thereby defines the associated common ink chamber 44. The compliance portions 42 are also parts of the elastic film 39.

In the vibration plate 32, if a certain piezoelectric element 10 is elongated in its longitudinal direction, the associated island portion 43 is pushed toward the associated recess 34, whereby the portion of the elastic film 39 around the island portion 43 is deformed and the associated pressure generating chamber 36 is contracted. If the piezoelectric element 10 is contracted in its longitudinal direction, the pressure generating chamber 36 is expanded due to the elasticity of the elastic film 39. The ink pressure inside the pressure generating chamber 36 is varied by controlling the expansion and contraction of the pressure generating chamber 36, an ink droplet (liquid droplet) is ejected from of the associated nozzle orifice 33.

Figure 4A:
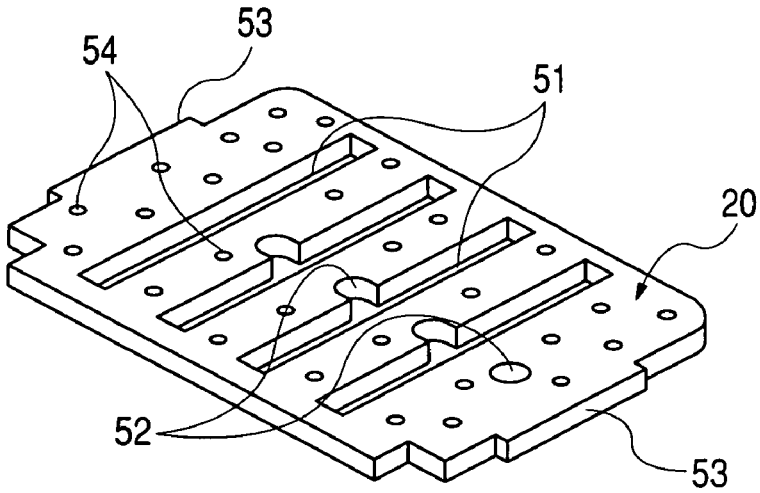
FIG. 4A is a perspective view of the appearance of a reinforcement member of the recording head.

Next, the reinforcement member 20 of the case 4 will be described. FIG. 4A shows an appearance of the reinforcement member 20. The reinforcement member 20 is a metallic plate member having a thickness of about 1 mm. In this embodiment, the reinforcement member 20 is made of stainless steel. In a plan view, the reinforcement member 20 is slightly smaller than the cavity-unit-joining surface of the case 4.

The reinforcement member 20 has housing openings 51 that surround the periphery of the respective chambers 12 of the case 4 and passage openings 52 that surround the respective ink supply passages 13. That is, the housing openings 51 are a size larger than the cross-sections of the chambers 12 and the passage openings 52 are a size larger than the cross-sections of the ink supply passages 13.

The recording head 1 according to this embodiment can eject four kinds of inks. Accordingly, the four actuator units 3, the four chambers 12, and the four ink supply passages 13 are provided. Therefore, the four housing openings 37 and the four passage openings 38 are provided.

Further, in this embodiment, projections 53 are provided at both ends of the reinforcement member 20 in the primary scanning direction of the recording head 1, which is used to place the reinforcement member 20 at a predetermined position when it is integrally molded with the case 4.

A plurality of through holes 54 are formed through the reinforcement member 20. Resin is introduced into the through holes 54 during the insertion molding, whereby the strength of connection between the reinforcement member 20 and the case 4 can be increased. With this structure, the deformation (expansion or shrinkage) of the case 4 due to the temperature or humidity variation can be securely suppressed. In this embodiment, the openings 51, 52 and the through holes 54 are formed by punching work.

Figure 4B:
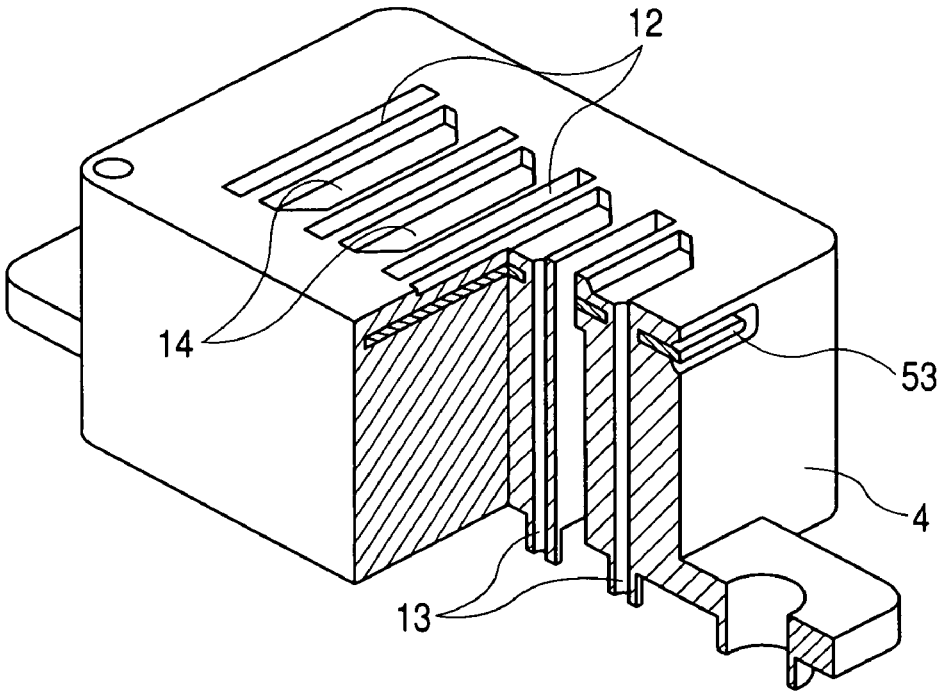
FIG. 4B is a perspective view showing a state that the reinforcement member is disposed in a casing of the recording head.

As shown in FIG. 4B, the reinforcement member 20 is integrally molded with the case 4 so as to be located in the vicinity of the surface to be joined with the cavity unit 5. In this embodiment, the reinforcement member 20 is disposed parallel with the surface at a position about 0.2 to 1 mm inside from the surface. That is, the reinforcement member 20 is combined with the case 4 by integral molding so as to be almost entirely buried in the case 4 except for the projections 53. In this manner, the case 4 and the reinforcement member 20 can surely be coupled with each other by integral molding. It is preferable that the reinforcement member 20 be located as close to the cavity-unit-joining surface as possible, because the effect of reinforcing the joining between the cavity unit 5 and the case 4 decreases as the distance between the reinforcement member 20 and the surface increases.

In this embodiment, the case 4 and the cavity unit 5 are bonded to each other by such a bonding method as film transfer. The film transfer is performed in the following manner. First, adhesive is applied to a surface plate and spread so as to have a thickness of about 10 μm. A film is placed on the adhesive in such a manner that no air bubbles are introduced. The adhesive is transferred to the film when the film is peeled off the surface plate. The adhesive-transferred film is stuck to a bonding surface and then peeled off, whereby the adhesive is peeled off the film and transferred to the bonding surface so as to have a thickness of about 5 μm. The adhesive is cured by heating. In this manner, subject members can be assembled with high accuracy because they are bonded to each other via a thin and uniform adhesive layer.

After the cavity unit 5 has been joined to the case 4, the actuator units 3 are inserted into the respective chambers 12 in such a manner that the free end portions of the piezoelectric element groups 2 are in contact with the cavity unit 5 (more specifically, the respective island portions 43). Then, the fixation plates 8 are joined to the inner walls of the chambers 12, respectively. For example, the fixation plates 8 are joined to the inner walls of the chambers 12 by letting adhesive flow into the gaps between the fixation plates 8 and the inner walls of the chambers 12 utilizing the capillary phenomenon.

As described the above, since the reinforcement member 20 made of metal is buried in the case 4 while being located in the vicinity of the surface to be joined with the cavity unit 5, in other words, since the linear expansion coefficient at the vicinity of the surface is matched with the linear expansion coefficient of the cavity unit, the relative expansion or shrinkage difference between the case 4 and the cavity unit 5 which is resulted from the temperature or humidity variation can be suppressed as much as possible. Accordingly, the reliability of bonding between the case 4 and the cavity unit 5 can be secured. Further, in comparison with the case where the reinforcement member 20 is simply bonded to the case 4, the positional offset or the peeling between the case 4 and the reinforcement member 20 can be prevented more securely.

In addition, since the reinforcement member 20 can be manufactured by press work, it is possible to attain mass-production during a short time period. Hence, in comparison with the case where the entire case is formed with metal, productivity is enhanced while reducing costs. Further, since the size or thickness of the reinforcement member 20 can be pertinently designed, adaptation for the large-sized recording head is easy.

Figure 5:
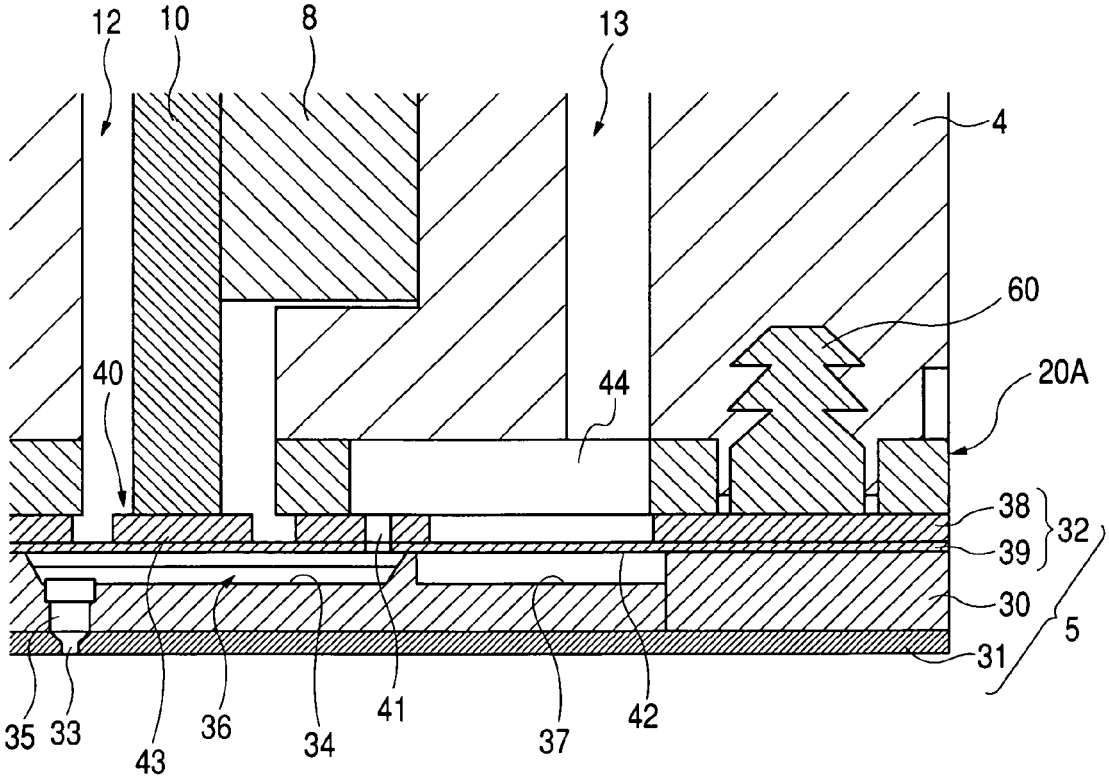
FIG. 5 is a sectional view of an essential part of a modified example of the recording head of the first embodiment.

Next, a modified example of the first embodiment will be described with reference to FIG. 5. Members as same as those in FIG. 2 will be designated by the same reference characters, and the repetitive explanations will be omitted. This example is characterized in that one surface of a reinforcement member 20A is exposed from the case 4. That is, the exposed surface of the reinforcement member 20A serves as the surface to be directly joined with the cavity unit 5 (more specifically, the support plate 38).

Figure 6A:
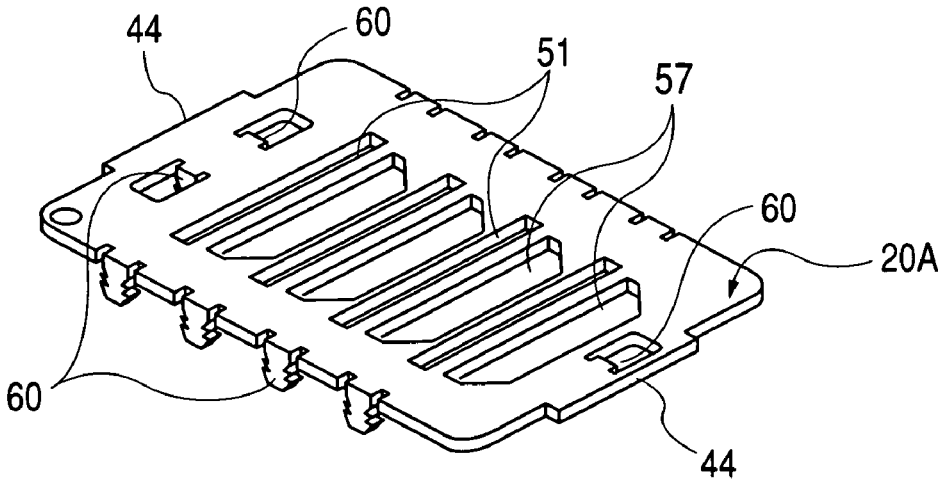
FIG. 6A is a perspective view of the appearance of a reinforcement member of the modified example.

As in the first embodiment, the reinforcement member 20A is a plate member made of stainless steel. As shown in FIG. 6A, the reinforcement member 20A is formed with housing openings 51 that surround respective chambers 12 of the case 4 and chamber openings 75 that serve as parts of respective common ink chambers 44. That is, the top and bottom openings of each chamber opening 75 are closed by the bottom surface of the case 4 and the associated compliance portion 34 of the vibration plate 32, respectively, whereby each chamber opening 75 defines the associated common ink chamber 44.

The reinforcement member 20A is also formed with a plurality of anchors 60 that project to the side opposite to its exposed surface (i.e., the surface to be joined with the cavity unit 5). Each anchor 60 is formed by shaping a portion of the reinforcement member 20A into a saw-toothed nail and bending it by about 9020 to the side opposite to the exposed surface. In this embodiment, the reinforcement member 20A is formed with three anchors 60 inside, that is, one anchor 60 that is close to one edge in the head main scanning direction (the right side in the figure) and two anchors 60 that are close to the other edge (the left side in the figure). The reinforcement member 20A is also formed with eight anchors 60 on both edges in the head secondary scanning direction, that is, four anchors 60 on each edge. That is, the reinforcement member 20A is formed with eleven anchors 60 in total.

Figure 6B:
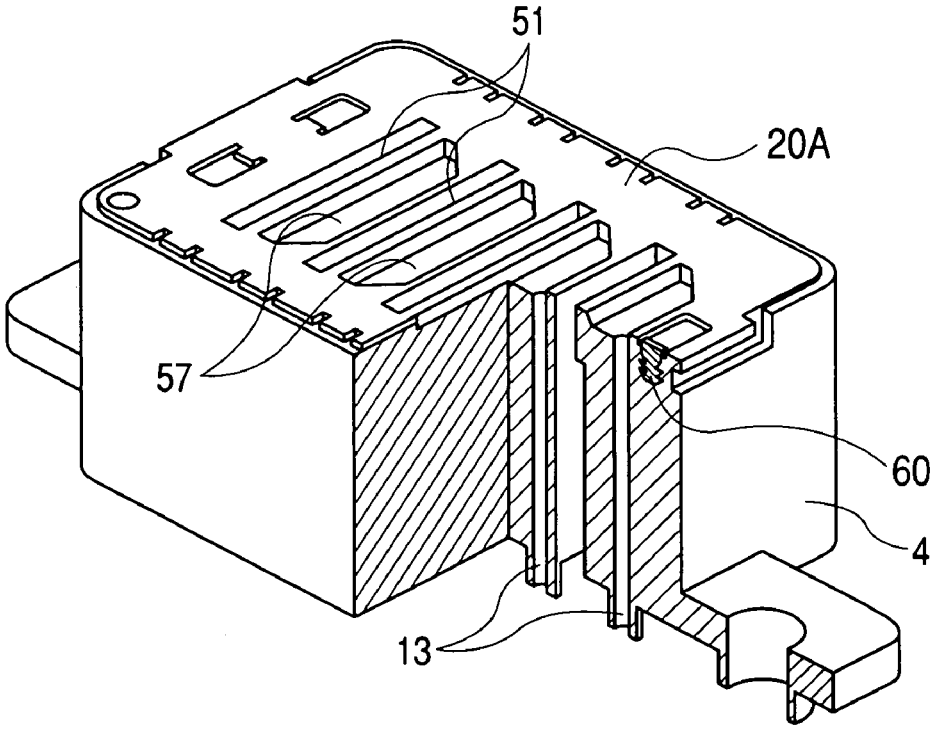
FIG. 6B is a perspective view showing a state that the reinforcement member is disposed in a casing of the modified example.
Figure 7:
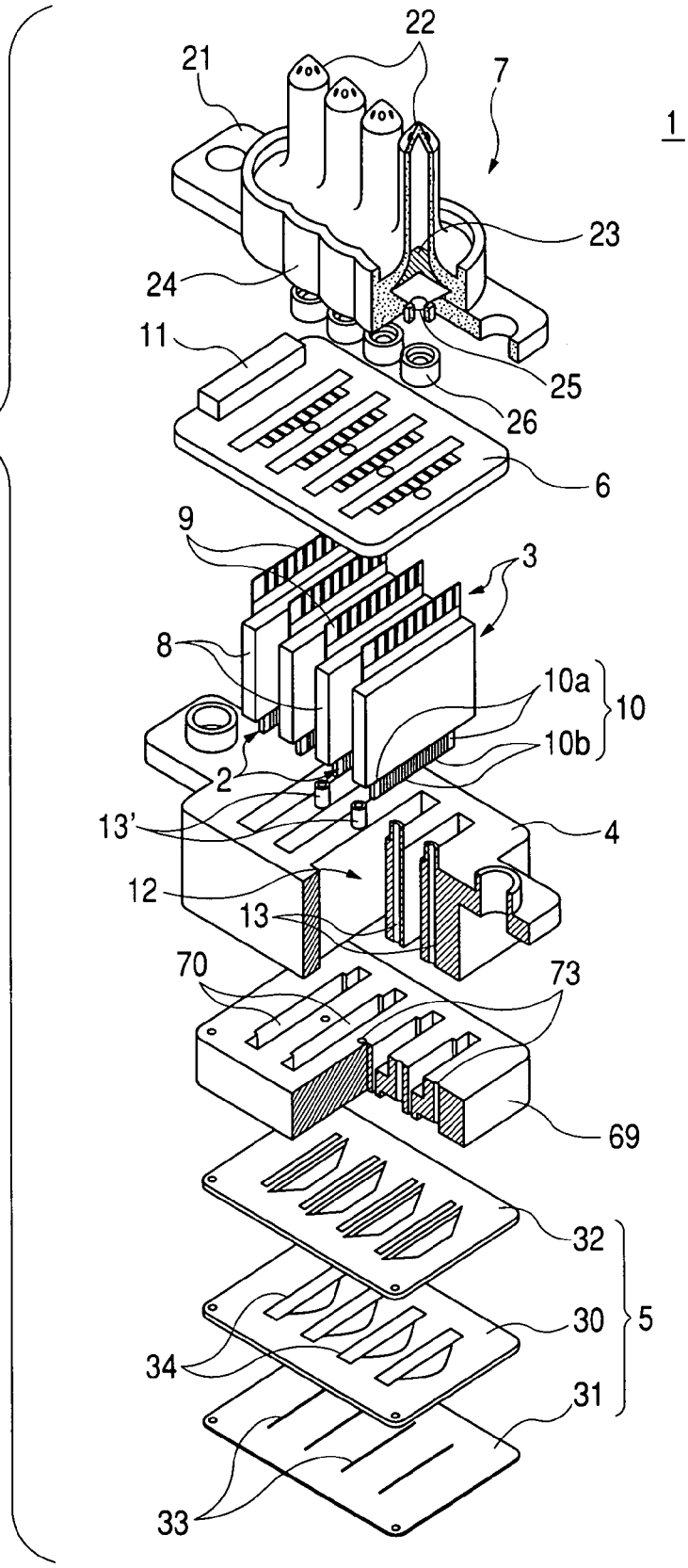
FIG. 7 is a perspective view of a disassembled recording head according to a second embodiment of the invention.
Figure 8:
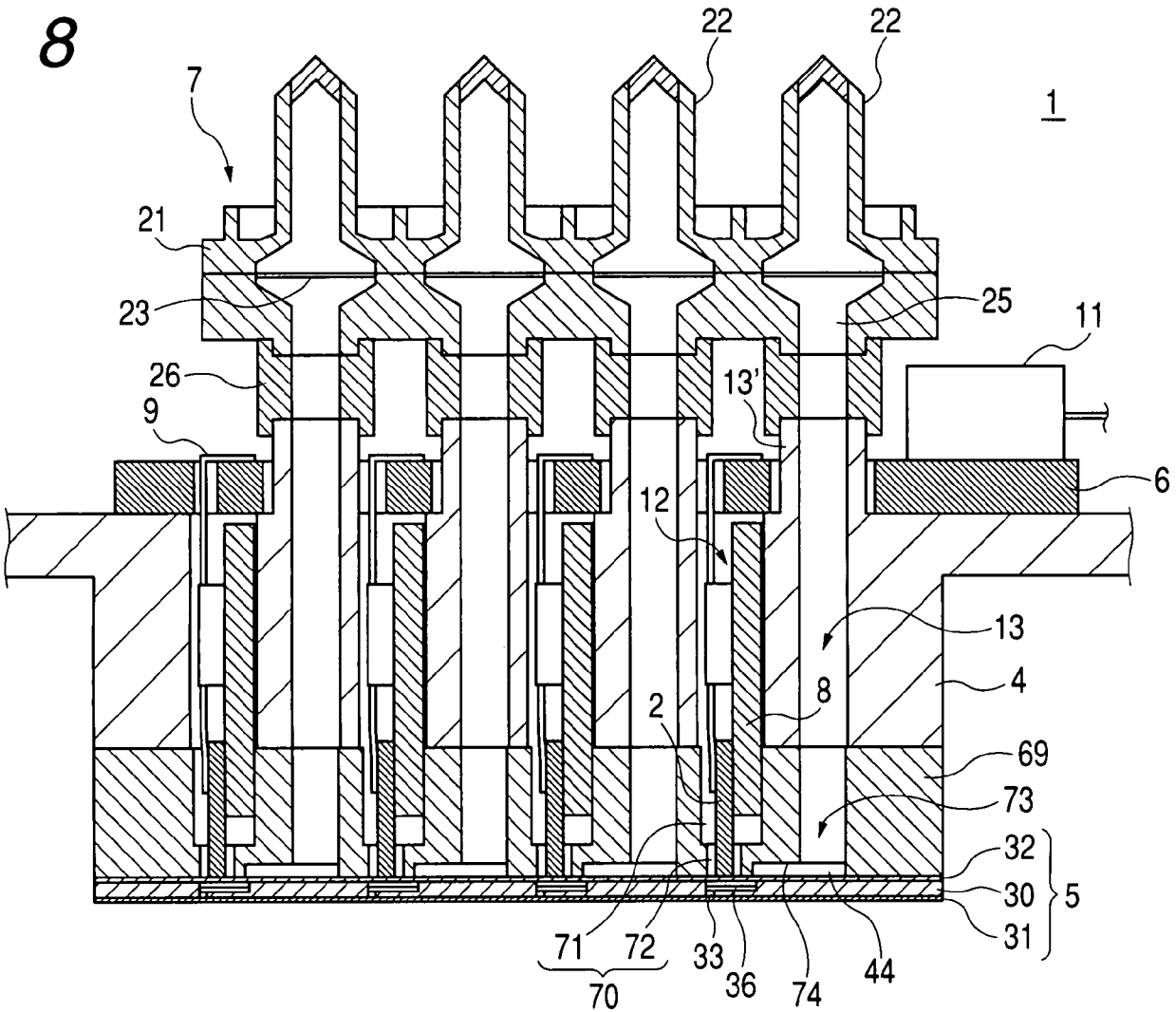
FIG. 8 is a sectional view of the recording head shown in FIG. 7.

As shown in FIG. 6B, the reinforcement member 20A is combined with the case 4 by integral molding so that its one surface is exposed as the surface to be joined with the cavity unit 5. Since the cavity unit 5 is directly joined to the exposed reinforcement member 20, the linear expansion coefficients of these members are matched with each other, thereby enhancing the reliability of bonding between the case 4 and the cavity unit 5.

Further, since the respective anchors 60 and a part of the reinforcement member 20A in the thickness direction thereof are integrally molded while being buried in the case 4, the coupling strength between the case 4 and the reinforcement member 20 can be enhanced.

The shape or number of the anchors 60 is not limited to the above described example, but may be pertinently selected or changed.

Next, a second embodiment of the first embodiment will be described. Members as same as those in the first embodiment will be designated by the same reference characters, and the repetitive explanations will be omitted. In this embodiment, the recording head 1 comprises a holder 69 serving as a reinforcement member which is disposed between the case 4 and the cavity unit 5.

The holder 69, which is a block-shaped metal member, is formed by forging and punching work by using stainless steel which is the same metal material as the fixation plates 8 and the cavity unit 5 are made of. In this embodiment, the actuator units are fixed and supported on the holder 69. The thickness of the holder 69 is set to 3.5 mm which is approximately the same as the longitudinal length of the piezoelectric elements 10. The reason why the thickness of the holder 69 is set to that value is to secure necessary and sufficient support (bonding) areas for support of the actuator units 3. This enables the holder 69 to well sustain reaction force from the, piezoelectric elements 10 during driving and to thereby stabilize the ejection property of the ink droplets.

The holder 69 is formed with actuator chambers 70 for accommodating the respective actuator units 3. Each of the actuator chambers 70 includes an upper chamber 71 formed so as to face the surface to be joined with the case 4, and a lower chamber 72 formed so as to face the surface to be joined with the cavity unit 5 and communicate with the upper chamber 71.

The upper chambers 71 are formed by plastic working so as to extend from the top surface of the holder 69 to a halfway position in the height direction in which the members for forming the recording head 1 is laminated. The lower chambers 72 are formed by punching the resulting workpiece to remove the portions from the bottom surfaces of the upper chambers 71 to the surface to be joined with the cavity unit 5. Therefore, the chambers 71 and 72 together penetrate through the holder 69 in the height direction.

Further, the holder 69 is formed with: ink supply passages 73 that communicate with the respective ink supply passages 13 of the case 4 and serve as parts of the ink flow passages are formed through the holder 69; and recesses 74 defining parts of the respective common ink chambers 44. The recesses 74 are formed by partially denting the bottom surface of the holder 69 by plastic working.

Figure 9A:
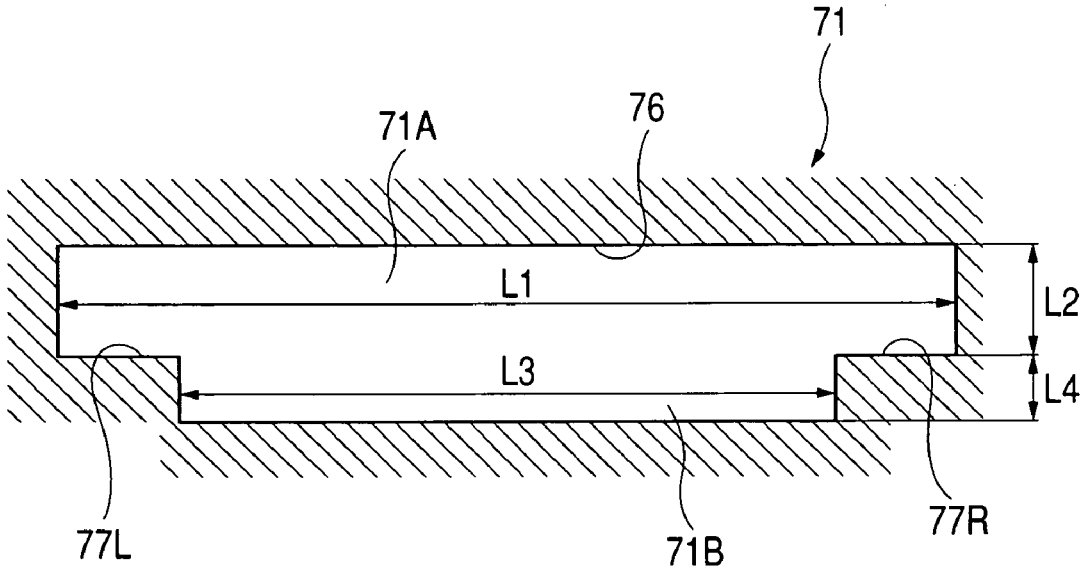
FIG. 9A is a plan view of an upper chamber in a holder of the recording head shown in FIG. 7.
Figure 9B:
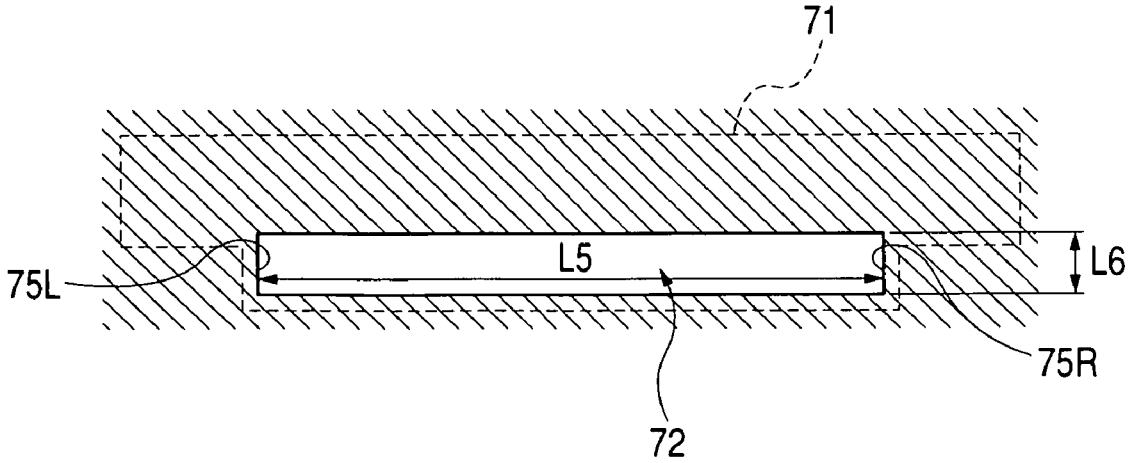
FIG. 9B is a plan view of a lower chamber in the holder of the recording head shown in FIG. 7.

FIG. 9A is a plan view showing an opening of the upper chamber 71 in the holder 69, and FIG. 9B is a plan view showing an opening of the lower chamber 72 in the holder 69. In the drawings, for the convenience of explanation, the secondary scanning direction of the recording head 1 is defined as an X-direction; the primary scanning direction of the recording head 1 is defined as a Y-direction; and the direction in which the members for forming the recording head 1 are laminated is defined as a Z-direction.

The upper chamber 71 is formed in such a manner that two upper chambers 71A and 71B having different dimensions are arranged in the Y-direction; the cross-section assumes an inverted-convex shape in the drawings. The upper chamber 71A is a cavity for accommodating and supporting the associated fixation plate 8, and its cross-section assumes a rectangular shape elongated in the X-direction. The lower chamber 71B is a cavity in which the associated piezoelectric element group 2 is inserted, and its cross-section assumes a rectangular shape that is a size smaller than the cross-section of the upper chamber 71A. The cross-section of the lower chamber 72 assumes a rectangular shape elongated in the X-direction and capable of accommodating the free end portion of the associated piezoelectric element group 2.

The dimension L1 of the upper chamber 71A in the X-direction (secondary scanning direction) is set slightly greater than that of the fixation plate 8 in the accommodated state, and the dimension L2 of the upper chamber 71A in the Y-direction (primary scanning direction) is set to such a value that the fixation plate 8 can be held there without play in its thickness direction, that is, a value that is approximately equal to the thickness dimension of the fixation plate 8. The dimension L3 of the upper chamber 71B in the X-direction is set somewhat greater than the longitudinal dimension L5 of the lower chamber 72, and the width dimension L4 of the upper chamber 71B in the Y-direction is set slightly greater than the Y-direction dimension of the piezoelectric element group 2 in the accommodated state.

The longitudinal dimension L5 of the cross-section of the lower chamber 72 in the X-direction (secondary scanning direction) is set at such a value that both ends (the dummy elements 10*a*) of the piezoelectric element group 2 in the accommodated state can be held there without play, and its width dimension L6 in the Y-direction (primary scanning direction) is set slightly greater than the Y-direction dimension of the piezoelectric element group 2 in the accommodated state.

Since the actuator units 3 are not fixed to the respective chambers 12 of the case 4, the cross-sections (inner dimensions) of the chambers 12 are made a size greater than the cross-sections of the upper chambers 71 of the holder 69.

In the assembling process, after the cavity unit 5 has been joined to the bottom surface of the holder 69, the actuator units 3 are inserted into the actuator chambers 70 (i.e., the upper chambers 71 and the lower chambers 72) in such a manner that the tips of the piezoelectric elements 10 are in contact with the respective island portions 43 of the vibration plate 32. As a result, positions of the piezoelectric elements 10 (i.e., the actuator units 3) in the Z-direction (member laminating direction) are determined with respect to the vibration plate 32 (i.e., the cavity unit 5).

At the same time, each piezoelectric element 10 is held between confronting inner walls 75L and 75R of the associated lower chamber 72, whereby positions of the tips of the piezoelectric elements 10 in the X-direction are determined with respect to the respective island portions 43. Further, each fixation plate 8 is held between a support wall 76 of the upper chamber 71A and its inner walls 77L and 77R that are opposed to the support wall 76, whereby positions of the tips of the piezoelectric elements 10 in the Y-direction are determined with respect to the respective island portions 43.

Since the dimensions of the actuator chambers 70 (71 and 72) are determined as described above, the actuator units 3 can be positioned accurately so that the tips of the piezoelectric elements 10 are located at their proper positions, that is, they correctly contact the respective island portions 43.

After the actuator units 3 have been positioned, the fixation plates 8 are bonded to the support walls 54 of the upper chambers 71, respectively. At this time, the fixation plates 8 may also be bonded to the inner walls 77L and 77R. One bonding method is to let a flowable adhesive flow into the gap between the bonding surface(s) of each fixation plate 8 and the bonding surface(s) of the support wall 76 (and the inner walls 77L and 77R) utilizing the capillary phenomenon and then setting the adhesive thus introduced. Other bonding methods may also be used.

Then, the case 4 is joined to the top surface of the holder 69 through film transfer, and the connection board 6 is attached to the top surface of the case 4 in such a manner as to be connected to the flexible cables 10 of the respective actuator units 3. Further, the supply needle unit 7 is attached to the case 4 with the packings 23 interposed in between.

Since as described above the holder 69, the fixation plates 8, and the members constituting the cavity unit 5 are made of the same metal material, that is, stainless steel, their linear expansion coefficients can be matched. Therefore, the relative expansion or shrinkage differences among these members due to the temperature or humidity variation can be suppressed. As a result, the offset between the piezoelectric elements 10 and the island portions 43 can be prevented, and the holder 69 and the cavity unit 5 or the members constituting the cavity unit 5 can be prevented from peeling off each other.

In many cases, water-based ink is used in the recording head 1 of this kind. Therefore, the members constituting the recording head 1 are required not to change in quality, for example, not to rust, even if they are brought into contact with water. In this connection, stainless steel is superior in rustproof performance and hence hard to change in quality, for example, hard to rust. Stainless steel is also better in cost than other materials.

Further, since the fixation plates 8 of the actuator units 3 are joined to the metallic holder 69, not only the affection of the deformation of the case 4 such as generation of crosstalk due to inclination of the actuator units 3 (the piezoelectric elements 10) can be prevented, but also the reaction force due to the actuation of the piezoelectric elements 10 can be sufficiently received by the holder 69. As a result, the driving of the piezoelectric elements can be normally conducted, thereby stabilizing the ejection of ink droplets.

Further, since the holder 69 and the fixation plates 8 are made of the metal material having high thermal conductivity, heat that is generated while the piezoelectric elements 10 are driven can be dissipated efficiently via the fixation plates 8 and the holder 69. This prevents excessive temperature increase of the piezoelectric elements 10.

Figure 10:
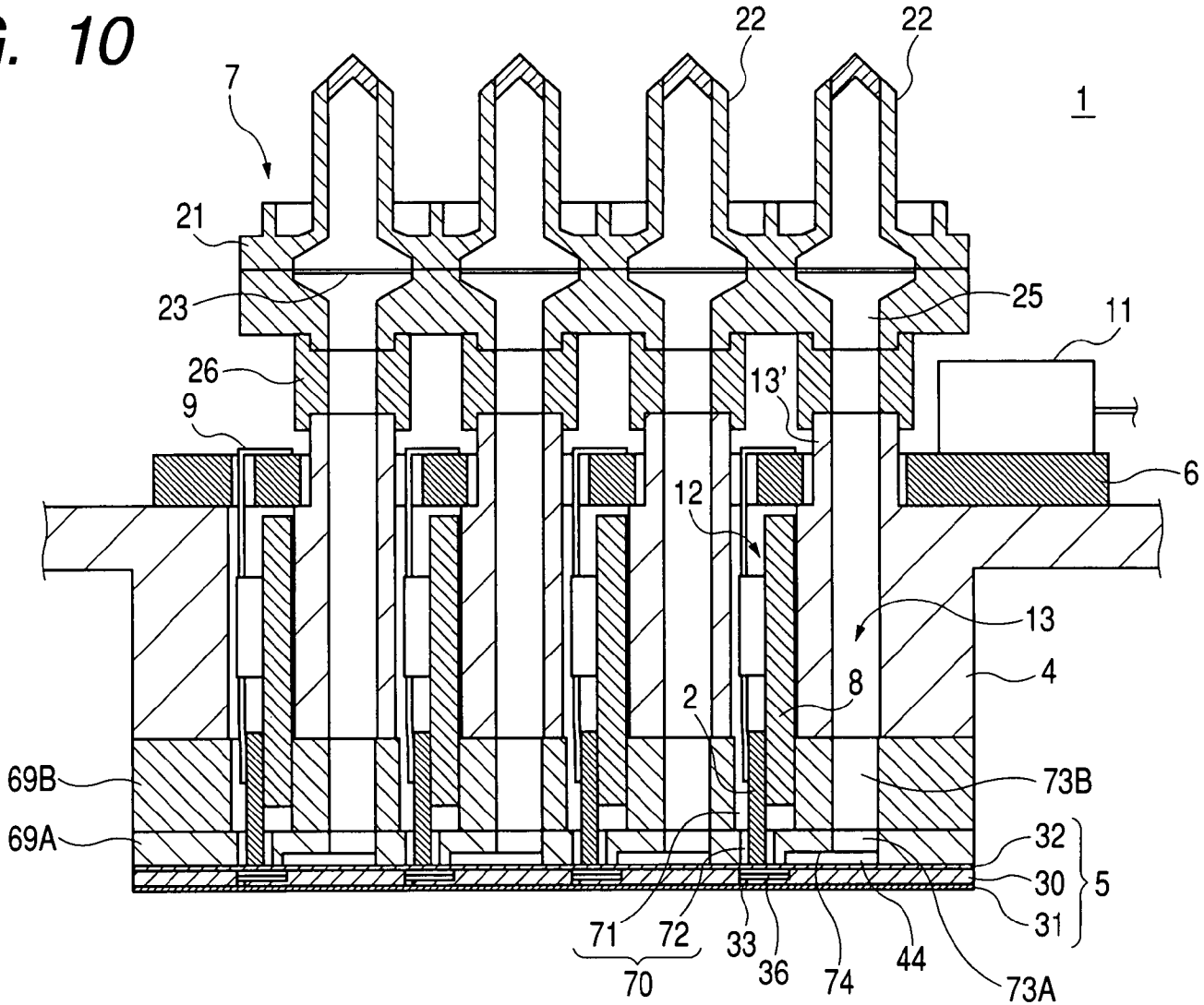
FIG. 10 is a sectional view of a modified example of the recording head of the second embodiment.

Next, a modified example of the second embodiment will be described with reference to FIG. 10. Members as same as those in the first embodiment will be designated by the same reference characters, and the repetitive explanations will be omitted. This example is characterized in that one single holder is formed by laminating two holder members 69A and 69B. As in the above described holder 69, the holder members 69A and 69B are formed by forging and punching by using stainless steel. The thicknesses of the holder members 69A and 69B are set to 1 mm and 2.5 mm, respectively.

Lower chambers 72, ink supply passages 73A, and recesses 74 are formed in the holder member 69A, and upper chambers 71 (71A and 71B) and ink supply passages 73B are formed in the holder member 69B. That is, the holder member 69A corresponds to the portion, in which the lower chambers 72 are formed, of the holder 69, and the holder member 69B corresponds to the portion, in which the upper chambers 71 are formed, of the holder 69. It can be said that the holder member 69A is a member for positioning the actuator units 3 in the secondary scanning direction of the recording head 1, and the holder member 69B is a member for positioning the actuator units 3 in the primary scanning direction of the recording head 1.

The holder members 69A and 69B have an advantage that they can be manufactured easily because they are thinner than the holder 69 and the upper chambers 71 and the lower chambers 72 can be formed as through-holes by punching work. In this example, the holder members 69A and 69B are joined to each other also by the above-described film transfer.

Incidentally, the invention is not limited to the above embodiments and various modifications are possible on the basis of the claims.

The reinforcement member 20 (20A), the holder 69 (the holder members 69A and 69B), the fixation plates 8, and the members constituting the cavity unit 5 may be made of a metal other than stainless steel such as pure nickel, aluminum (without surface treatment), or aluminum (with the surface subjected to alumite treatment or nickel plating) as long as the above-described requirements such as the requirement relating to the linear expansion coefficients and the requirement relating to the rustproof performance are satisfied. The members may be made of different metal materials. However, from the viewpoint of matching the linear expansion coefficients, it is desirable that the members be made of the same metal.

In the above embodiments, the respective members are joined to each other by the film transfer. However, the invention is not limited to such a case. For example, adhesive may directly be applied to a bonding surface of one member or an adhesive tape may be used.

In the second embodiment, each of the actuator chambers 70 in the holder 69 is formed by the upper chamber 71 and the lower chamber 72. However, if the holder 69 (thickness: 3.5 mm) can be punched by a single press, the upper chamber 71 and the lower chamber 72 may be a through hole formed collectively. In this case, the longitudinal inner dimension of the cross-section of the through hole is set to such a value that both ends of a piezoelectric element group 2 in the direction that the piezoelectric elements 10 are arrayed can be held.

In the second embodiment, the holder 69 (the holder members 69A and 69B) and the case 4 are joined through the film transfer. However, the holder 69 may be partly or entirely buried in the case 4 through integral molding. In this case, through holes may be formed in the holder 69 (the holder members 69A and 69B) for receiving resin material forming the case 4 when the integral molding is performed. Anchors may be formed so as to project to the side opposite to the surface of the case 4 to be joined with the cavity unit 5.

In the second embodiment, a holder (reinforcement member) is formed by the single holder 69 or the two holder members 69A and 69B. However, a holder may be a stack of three or more holder members in which the upper chambers 71 (or chambers 71A and 71B) is formed in a holder member for accommodating the fixation plates 8 and the lower chambers 72 are formed in one of the remaining holder members for accommodating the free end portions of the piezoelectric elements 10. For example, a holder may be formed by a total of three holder members that are a member in which the recesses 74 and parts of the respective lower chambers 72 are formed, a member in which the remaining parts of the respective lower chambers 72 and parts of the respective the ink supply passages 73 are formed, and a member in which the upper chambers 71 and the remaining parts of the respective ink supply passages 73 are formed. This structure makes it possible to also form the recesses 74 as through-holes by punching, and hence facilitates the working for manufacturing the holder.

Although the above description is directed to the case that the invention is applied to the ink jet recording head, the invention is not limited to such a case. For example, the invention can also be applied to other kinds of liquid ejection heads such as colorant ejection heads used for manufacture of color filters of a liquid crystal display etc., electrode material ejection heads used for formation of electrodes of an organic EL display, an FED, etc., and bio-organic material ejection heads used for manufacture of bio-chips.

What is claimed is:

1. A liquid ejection head, comprising: a metallic cavity unit, formed with liquid flow passages respectively continued from a common liquid reservoir to nozzle orifices via pressure chambers; an actuator unit, in which a plurality of piezoelectric elements are supported on a fixation plate in a cantilevered manner; a resin casing, formed with a first face onto which the cavity unit is bonded, the casing having an actuator chamber which accommodates the actuator unit therein such that free ends of the piezoelectric elements are abutted onto the cavity unit; and a metallic reinforcement member, integrally molded with the casing such that at least a part thereof is buried in the casing at the vicinity of the first face, wherein the reinforcement member extends in the casing so as to surround the actuator chamber.

2. The liquid ejection head as set forth in claim 1, wherein a whole body of the reinforcement member is buried in the casing.

3. The liquid ejection head as set forth in claim 1, wherein the reinforcement member is formed with a hole filled with resin forming the casing.

4. The liquid ejection head as set forth in claim 1, wherein a part of the reinforcement member serves as the first face.

5. The liquid ejection head as set forth in claim 1, wherein the reinforcement member is comprised of a metal selected from the group consisted of stainless steel, nickel, aluminum, alumetized aluminum and nickel-plated aluminum.

6. The liquid ejection head as set forth in claim 1, wherein the reinforcement member is formed with a passage opening.

7. A liquid ejection head, comprising:

a metallic cavity unit, formed with liquid flow passages respectively continued from a common liquid reservoir to nozzle orifices via pressure chambers;

an actuator unit, in which a plurality of piezoelectric elements are supported on a fixation plate in a cantilevered manner;

a resin casing, formed with a first face onto which the cavity unit is bonded, and an actuator chamber which accommodates the actuator unit therein such that free ends of the piezoelectric elements are abutted onto the cavity unit; and a metallic reinforcement member, integrally molded with the casing such that at least a part thereof is buried in the casing at the vicinity of the first face, wherein the reinforcement member is formed with an anchor member projecting into the casing.

* * * * *